United States Patent [19]

Moorehead et al.

[11] Patent Number: 4,507,735

[45] Date of Patent: Mar. 26, 1985

[54] METHOD AND APPARATUS FOR MONITORING AND CONTROLLING WELL DRILLING PARAMETERS

[75] Inventors: Robert M. Moorehead; Susan G. Eppler; Mardis V. Anderson, all of Richardson, Tex.

[73] Assignee: Trans-Texas Energy, Inc., Dallas, Tex.

[21] Appl. No.: 390,577

[22] Filed: Jun. 21, 1982

[51] Int. Cl.[3] ..... G06F 3/00; G06F 15/16; E21B 47/00

[52] U.S. Cl. ..... 364/422; 73/151; 324/323; 340/825.06; 340/853; 364/132; 364/185; 367/25; 367/911

[58] Field of Search ..... 364/422, 132, 496, 497, 364/499, 185; 367/25, 26, 33, 86, 911, 912; 73/151, 152, 153; 340/853, 661, 500, 856, 825.06, 825.36; 324/323, 324, 339; 235/311

[56] References Cited

U.S. PATENT DOCUMENTS

| | | | |
|---|---|---|---|
| 3,602,322 | 8/1971 | Gorsuch | 175/48 |
| 3,726,136 | 4/1973 | McKean et al. | 175/48 X |
| 3,740,739 | 6/1973 | Griffin et al. | 175/48 X |
| 4,096,385 | 6/1978 | Marett | 364/497 X |
| 4,216,536 | 8/1980 | More | 367/25 X |
| 4,263,583 | 4/1981 | Wyckoff | 340/661 X |
| 4,310,887 | 1/1982 | Suau | 340/853 X |
| 4,342,026 | 7/1982 | Hanson | 235/311 X |
| 4,432,064 | 2/1984 | Barker et al. | 364/132 X |

OTHER PUBLICATIONS

"M/D 3200 Data Processing System"; Martin-Decker; 9/81.

"Enter a Totally New Concept in Logging System Design"; N. L. Baroid/NL Industries, Inc.; 4/81.

*Primary Examiner*—Errol A. Krass
*Assistant Examiner*—Kevin J. Teska
*Attorney, Agent, or Firm*—Kanz, Scherback & Timmons

[57] ABSTRACT

A mud logging system for receiving and displaying conditions measured during the drilling of a well includes a plurality of units for receiving and processing signals from sensors responsive to the values of the conditions. A/D convertors in each of said units produce digital representations of signals received from the sensors and the digital representations are utilized with visual display means in the units for digitally displaying values of the conditions. A slave computer of the digital type is interfaced with the A/D converters and a file disk. Under control of said slave computer the digital representatives are transferred to the file disk, and a recorder also under control of the slave computer displays selected ones of the conditions. The system also includes a master computer of the digital type connected to access data on the file disk, to utilize the accessed data to provide for analysis of drilling conditions.

17 Claims, 4 Drawing Figures

METHOD AND APPARATUS FOR MONITORING AND CONTROLLING WELL DRILLING PARAMETERS

BACKGROUND OF THE INVENTION

1. Field of the Invention

This invention relates generally to improvements in monitoring methods and apparatus and more particularly to methods and apparatus for monitoring or logging the parameters of conditions encountered during the course of drilling a well .

2. Description of the Prior Art

During various drilling operations particularly those related to the rotary drilling of an oil or a gas well, a drilling fluid is commonly circulated and partially retained in the borehole for various reasons, as for example, to exert hydrostatic pressure to keep the gas pressure substantially sealed in the borehole and to remove drill bit cuttings from the borehole. During the startup of the drilling operation and during the drilling operations themselves, it is important that the operator have available certain information including that relating to the flow of the drilling fluid so that the operator will be in a position to quickly and intelligently make certain operational or procedural decisions relating to the drilling operation. For example, the rate the drilling fluid is being pumped into the borehole, volume of the drilling fluid in the fluid pits and the rate the drilling fluid is being returned to the fluid pits constitutes some of the drilling fluid parameters needed by the operator.

The above mentioned drilling fluid parameters provide an indication to the operator of certain possible problems which may exist at various times during the drilling operations. For example, an increase of the volume of drilling fluid in the fluid pits may indicate a possible "blow out", and thereby provide a basis for an operator's decision to increase the weight of the drilling fluid being circulated into the borehole. On the other hand a decrease in volume of the drilling fluid may indicate a possible loss of drilling fluid in the formation, a condition commonly referred to as "loss-circulation". Further a knowledge of the relative flow of drilling fluid in the return flow line generally indicates to the operator such conditions, as for example, that the borehole is stable and drilling operations may be conducted.

Other parameters usually measured during the drilling operations include hook load, weight on bit, and rotary rate standpipe pressure and rotary torque which with rate of penetration are helpful in determining the optimum values of the stated parameters to efficiently and safely drill the various subsurface formations.

Various solutions have been offered in the past to provide an operator with some if not with all of the aforementioned parameters or data. However, as drilling operations have become more complex and sophisticated due to efforts to locate hydrocarbons at increasing depths, it has become more important that the operator have available in an immediate and usable form the maximum drilling data which includes sufficient drilling-fluid parameters upon which the various operational decisions can be quickly and efficiently based.

Sophisticated design has led to the utilization of computers or micro processors which in known systems have been made the heart of such systems in that data received from various sensors located about the drilling system are first fed to the micro processors where the data are converted to binary form and thereafter transmitted to visual display devices including LED display and chart recorders. The disadvantage of such systems lies in the fact that when the micro processor goes down for one reason or another the operator is effectively blind in conducting the drilling operations and until the micro processor is returned to a useful state, a potentially hazardous condition exists during which time the operator is unable to know what if any corrective action to take upon the occurrence of a sudden change in drilling conditions.

In addition to merely monitoring the existing drilling conditions, it is also desirable that the drill site geologist and engineer have the capability of utilizing the parameters in further analysis of the drilling conditions such for example as critical velocity, slip velocity, and equivalent circulating density.

Accordingly it becomes important that in view of the size and complexity of modern drilling rig systems that a reliable, accurate system be provided of monitoring and analyzing drilling parameters more efficiently and with added safety to conduct well drilling operations.

SUMMARY OF THE INVENTION

In accordance with the present invention there is provided a system for monitoring and controlling well drilling parameters, which from time to time will be referred to herein as a mud logging system, during the drilling of a well which includes a plurality of units for receiving and processing signals from sensors responsive to the values of the parameters or conditions. A/D converters in each of said units produce digital representations of signals received from the sensors and visual display means in the units are responsive to the outputs of the A/D converters for digitally displaying values of the conditions. A slave computer of the digital type is interfaced with the A/D convertors and with a file disk. The slave computer controls the transfer of the digital representations to the file disk and also controls a plotter for continuously displaying selected ones of the conditions and a printer for displaying data during an alarm condition and every foot in depth.

The system also includes a master computer of the digital type connected to access data from the file disk to provide for on site analysis of drilling conditions.

The slave computer is also initially programmable to provide for on site analysis of drilling conditions and is initially loaded from a programmed disk but thereafter is rendered independent of changes made to program instructions on the program disk by way of the master computer. The foregoing achieves the object of rendering the slave computer independent of any changes that might be introduced by unauthorized personnel.

It is an object of the present invention to provide a reliable, cost effective, high performance mud logging system having ease of maintainability.

It is a further object of the present invention to provide independent units so that in the event one unit goes down it will not effect the operation of the other units.

It is another object of the present invention to provide for the acquisition of drilling data or parameters while concurrently accessing previously stored data and utilizing it in the analysis of drilling conditions or in the generation of synthetic logs, depicting the machanical values of all of the forces used in drilling as well as properties of the rock and fluids contained within the rocks penetrated.

Other features, objects and advantages of the invention will be evident from the following detailed description when read in conjunction with the accompanying drawings illustrating one embodiment of the invention.

DESCRIPTION OF THE PREFERRED EMBODIMENT

Figure 1:
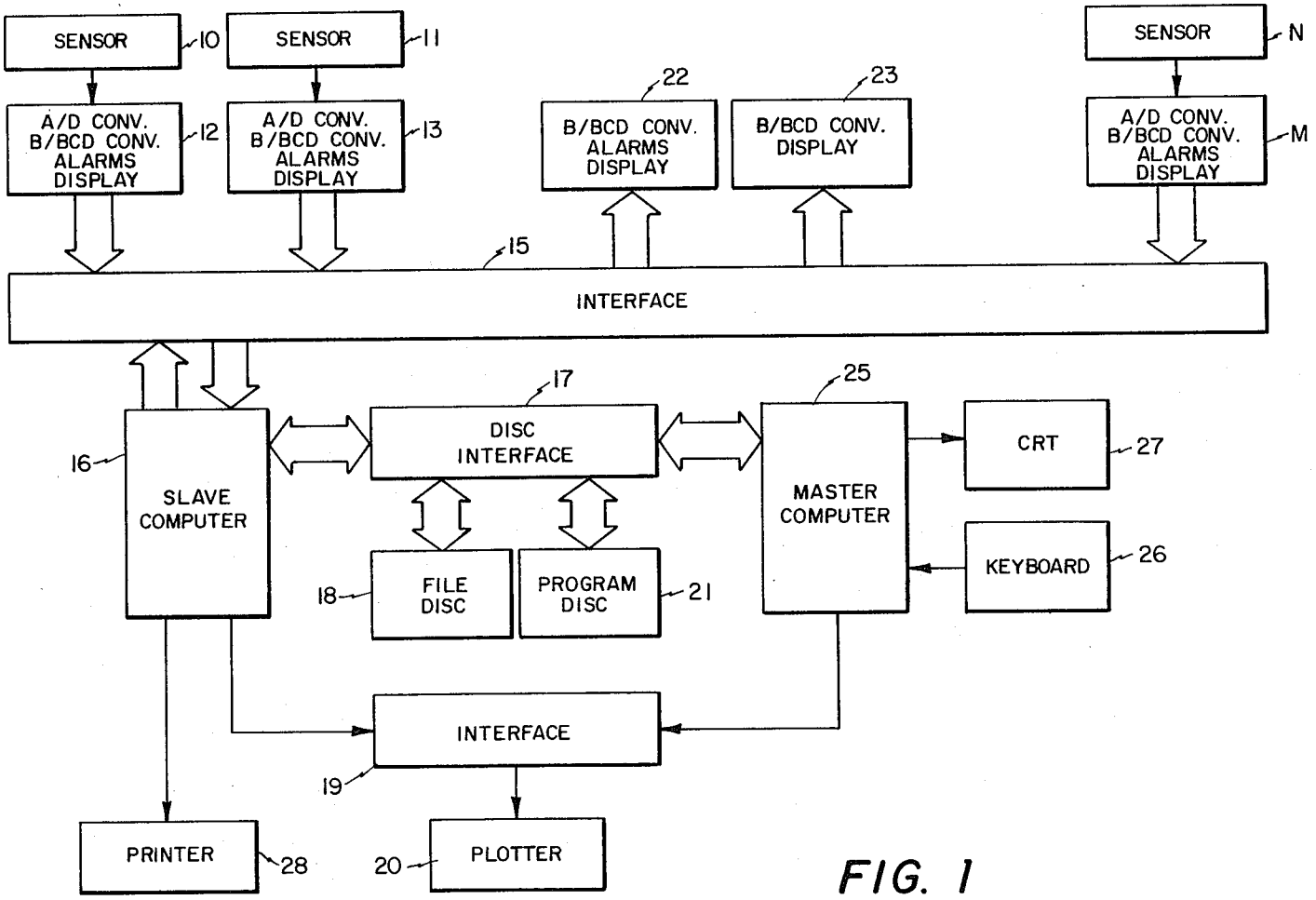
FIG. 1 is a block schematic of a system for monitoring and controlling well drilling parameters constructed in accordance with the present invention.

Referring to the drawings in general and to FIG. 1 in particular, shown therein is the system for monitoring and controlling well drilling parameters adapted to provide an instantaneous and continuous indication of various drilling condition parameters detected by sensors 10, 11–N. The sensors, all commercially available, are arranged about the drilling system at the surface to detect various drilling parameters such for example as the input and output temperature, conductivity, and density of the drilling fluid, pump pressure, hook load, rotary rate, rotary torque, pump stroke rate, and depth. These various parameters are set forth as exemplary only. The number and type of sensors as well as the number of parameters being measured are all optional with the operator.

The outputs of the sensors 10, 11–N, typically analog, are fed respectively to units 12, 13–M where the analog signal is converted to binary form. The binary representation of each parameter is then transformed to BCD format which is utilized to drive a numerical display of the parameter. The display is preferably of the LED type. Each of the units 12, 13–M also include audible and visual alarms which are operator set to acceptable upper and lower limits and which are triggered whenever the measured parameters vary outside these limits.

Each of the units 12, 13–M are in effect self contained, operating independently of one another and from the remainder of the system. The advantage being that the breakdown of any one of the units or indeed a breakdown in the remainder of the system will not effect the remaining units from continuing their function to display to an operator the values of other measured drilling parameters. This is significant in making possible the continued safe conduct of drilling operations which are not otherwise available in those present day systems where the measured drilling parameters are all applied to a single unit for processing and conditioning prior to being displayed. It is obvious that a breakdown of that single unit will cause a shutdown of the system as a whole and render unsafe continued drilling operations.

It is important that there be recorded for analysis either in effectively real time or at a selected later time the drilling parameters and to that end the binary representations of the measure parameters are applied from the units 12, 13–M by way of associated buses to a read-write interface 15. Coupled to the interface 15 by way of read-write buses is a dedicated computer 16 of the digital type hereinafter referred to as a slave computer which serves several functions. The gathered binary data are stored momentarily in the slave computer 16 and at selected times dumped by way of disk interface 17 to file disk 18. The dumping takes place in intervals from 5 to 15 minutes. If desired the dumping interval may be shorter. The output of the slave computer 16 is also coupled to plotter interface 19 and thence to plotter 20 where selected data are recorded as a series of analog curves representing a record of variations in drilling parameters during the course of the day. These data are plotted in real time, or to any linear scale selected by the operator such as depth.

In addition to effecting the real time plotting of selected measured parameters the slave computer 16 is also programmed to calculate from the measured parameters stored in its memory other functions that are useful in conducting drilling operations. Among them are rate of penetration and chloride content of the drilling mud. These computations are conducted in real time and read by way of interface 15 to units 22 and 23. More specifically the rate of penetration will be applied to the unit 23 where the binary representation is converted to BCD and displayed. Inasmuch as the rate of penetration is a statistical figure, there is no need to provide for an alarm. On the other hand the chloride content of the drilling mud is applied by way of interface 15 to the unit 22 where the binary representation is converted to BCD visually displayed, and there are provided in that unit 22 limits of acceptable chloride content. Deviation from the acceptable limits will initiate the operation of an audible and visual alarm.

The rate of penetration is calculated in the manner well known in the art in that there are utilized depth measurements and time to produce a function representing the rate at which the hole is being made in the drilling operation.

The determination of chloride content is in acordance with the expression $$F = \frac{16070 \times 10^{\left(\frac{50-T}{350}\right)\times(1.4517+.07367 \log R)}}{1.05166R} \qquad (10)$$

where:

F=chloride content in parts per million

R=reciprocal of conductivity in ohms per meter

T=temperature of the mud in degrees Fahrenheit

The chloride ion concentration is used by the operator to determine if the salt water is entering the bore due to insufficient hydrostatic pressure as well as providing information to effectively treat the drilling mud. Many of the drilling muds are ineffective when contaminated with salt. The slave computer 16 is initially loaded from program disk 21 by way of disk interface 17. Once the program for the slave computer is loaded in its random access memory an interlock prevent any modification to the loaded program. This now makes the program disk 21 available for other use, as will be described hereinafter, without interferring with the data acquisition and computational operations of the slave computer 16.

The slave computer 16 may be of any one of several commercially available computers. One such computer is sold under the trademark APPLE II. It is not only inexpensive but flexible enough to provide for the necessary controls in data acquisition and computation but is easily programmed in BASIC. Accordingly, all that need be done to effect the operation of the slave computer is to define the functions to be provided and it becomes well within the skill of the ordinary programmer to provide the instructions in order for the slave computer to implement those functions.

The interface 19 is an APPLE RS232A interface and the plotter 20 is a Integral Data Systems, Inc. Prism Printer. The plotter 20 produces an analog curve or curves of the selected measured parameters. It is much preferred to those recorders which merely print columns of numbers because the analog curves and their variations are more readily intepreted by an operator.

The printer 28 is an Integral Data Systems, Inc. Prism Printer. When an alarm condition exists the printer prints preselected data. This feature gives the operator exact data rather than trend data which is obtained from the plotter.

As aforementioned, it now becomes clear that the display of measured parameters by units 12, 13–N are quite independent of the slave computer 16. Should the computer 16 go down for any reason there will be lost the function of recording the data on the file disk 18 and of course the recording of the analog curves by the plotter 20. In addition the displays in units 22 and 23 will go out. However, but most important, drilling can safely be continued inasmuch as units 12, 13–M are self-contained and operate independently of one another and of the slave computer 16.

The system as thus far described is adequate to provide for real time observation of variations in drilling parameters and to record on disk as well as the chart recorder selected ones of the drilling parameters. The analysis of the recorded data particularly that on the file disk can be performed at a central office location either by shipping the file disk or by transmitting the recorded data via a modem (not shown) connected to telephone lines directly to a central computer. However, it is preferred that the analysis of the data takes place at the site and to that end there is provided a master computer 25, another APPLE II computer, coupled by way of disk interface 17 to both the file disk 18 and the program disk 21. Under control of an operator utilizing keyboard 26 the master computer is enabled to call data from the file disk to perform analysis through calculation of the D exponent or to produce synthetic logs all under control of programs on the program disk or on supplemental floppy disks substituted for the original program disk.

In the manner well known in the art the operator will select a program. Instructions to the operator as to how to carry out requests of data will be visually displayed on the cathode ray tube (CRT) 27.

Some typical calculations would involve the hydraulics of the drilling system and accordingly the operator will enter certain data such as pipe diameter, casing diameter, depth of hole. From the file disk he will be able to acquire such data as mud weight, mud temperature and perhaps flow rate. In all instances the operator would be prompted on the screen of the CRT to enter the various parameters and have the computer calculate the type of flow whether a laminar or turbulent and other calculations such as slip velocity. The results of the computation would be displayed on the CRT 27.

There are circumstances under which the master computer 25 would take over control of the plotter in order to more critically examine the onset or the occurrence of an anomaly appearing on one or more of the curves being plotted by the plotter. The plotter itself is capable of recording over varying time spans. Now in the event that an anomaly is suspect it would be desired to expand the presentation to obtain higher resolution. This is accomplished by the operator pressing a reset key on the plotter and inserting a preprogrammed disk in program disk drive 21, and there would appear on the screen of the CRT an inquiry as to which parameter the operator wanted expanded. Prompted by the CRT the operator would load the desired parameter, for example, mud flow and then be prompted by the computer as to the time period to be expanded. For example, he could expand the chart to cover a period of one hour. Accordingly, he might pick a particular hour, say 10:00 AM to 11:00 AM and then enter the time 10:00 AM on the keyboard. The disk file 18 would be searched and the parameters or the values of the selected parameter would be pulled from the disk file and by way of the master computer and plotted in expanded form by the plotter 20. After the expanded recording has been produced by plotter 20, the plotter will be reset and the slave computer 16 again regain control of the plotter and the recording process previously interrupted is reestablished.

The system comprising the units 12, 13–M, 22 and 23 together with the slave computer 16 and the master computer 25 provides for maximum utilization of measured drilling parameters limited only by the imagination of the operator. With the availability of the master computer and the slave computer whose operation is uninterrupted by use of the master computer an operator, such as a well site geologist, is free to do his own programming and to treat whatever data he selects from the file disk to conduct any desired analysis of the drilling operation.

Figure 2:
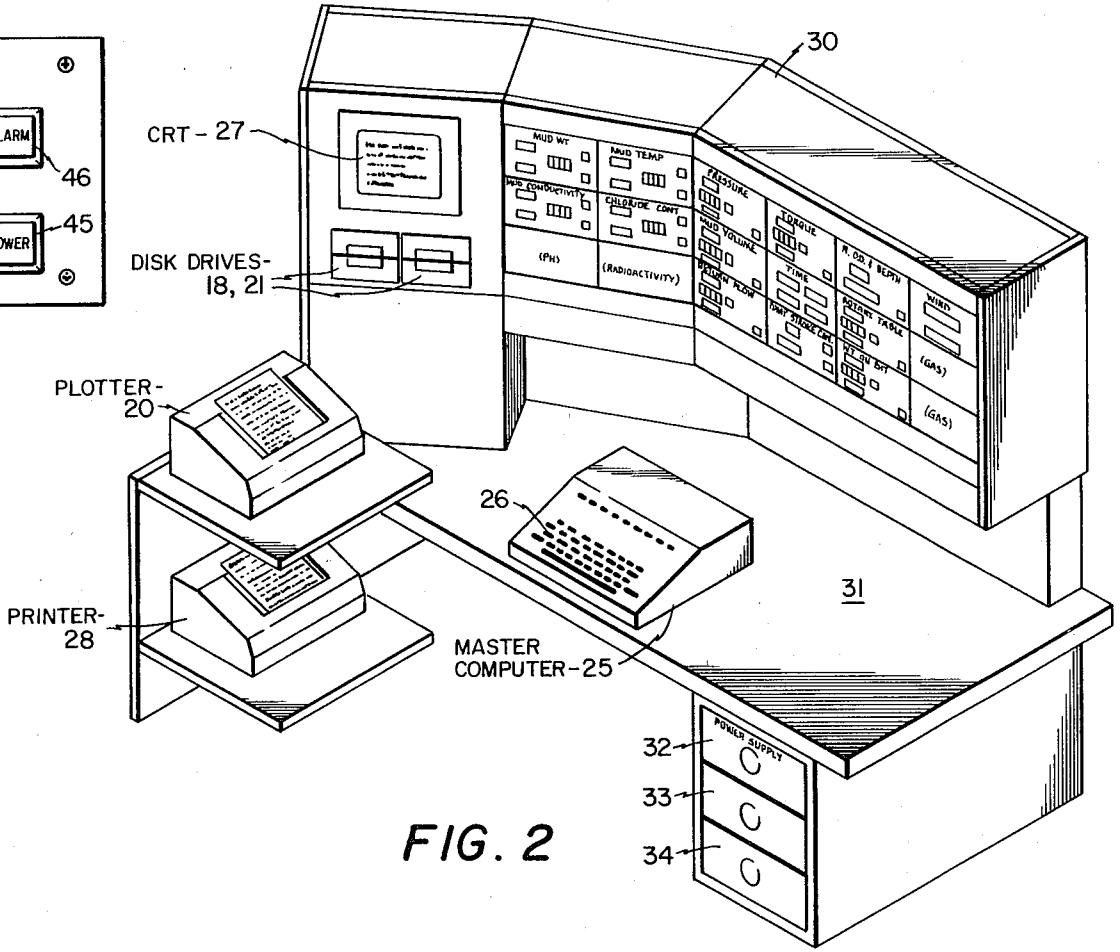
FIG. 2 illustrates a console in which the various units and components of the system are mounted for ready observation and ease of operation.

The system of FIG. 1 is conveniently housed in a console 30 illustrated in FIG. 2. The various display panels for the units 12, 13–M are mounted in the upper portion of the console 30 with the identity of the measured parameter printed on the panel such for example as mud weight, mud temperature, mud volume, torque, rate of penetration and depth, etc. The printer 28 and plotter 20 are located on shelves one above the other to the left of an operator sitting before the keyboard 26 of the master computer 25. The file disk drive 18 and program disk drive 21 are mounted below the screen of CRT 27. The arrangement provides for high visibility of panels and ease of system operation. The slave computer is located under the writing surface 31 of the console.

Power supplies for the system are conveniently located in pullout drawers 32, 33 and 34. There are three separate power supplies whose output are distributed by way of a network or bus (not shown) to the various components of the system. The power supplies are designed such that any two of them are adequate to supply full power to the system. This is another feature of the system in providing redundancy so as to avoid a breakdown in operations of the system. Should one of the power supplies go down, the distributing network can be modified by strapping or otherwise by readily making reconnections through the distributing network.

Figure 3:
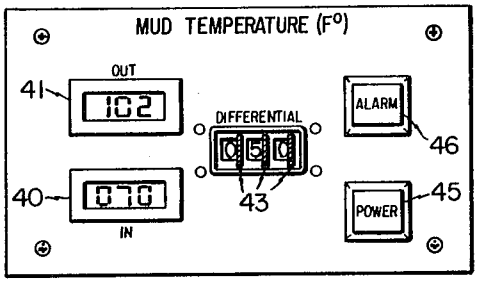
FIG. 3 represents the front panel of a selected one of the units for displaying mud temperature.

An enlargement of the front panel of the mud temperature unit is illustrated in FIG. 3. There the mud temperature both "in" and "out" is displayed by way of LEDs 40 and 41 and the acceptable differential in mud temperatures, set by the operator, is numerically displayed at 42. The differential is manually set through the use of thumb wheels 43. The front panel includes a manual power switch 45 and the visual alarm 46 which is excited whenever the differential in mud temperature exceeds the preset value established by adjustment of thumb wheels 43.

The front panel of FIG. 3 is merely exemplary of the panels to comprise the upper portion of the console 30. Common to all of them is LED display of the measured parameter, a manually operated power button and in many instances a thumb-wheel switch for differential or acceptable upper and lower limits of the drilling parameters.

Figure 4:
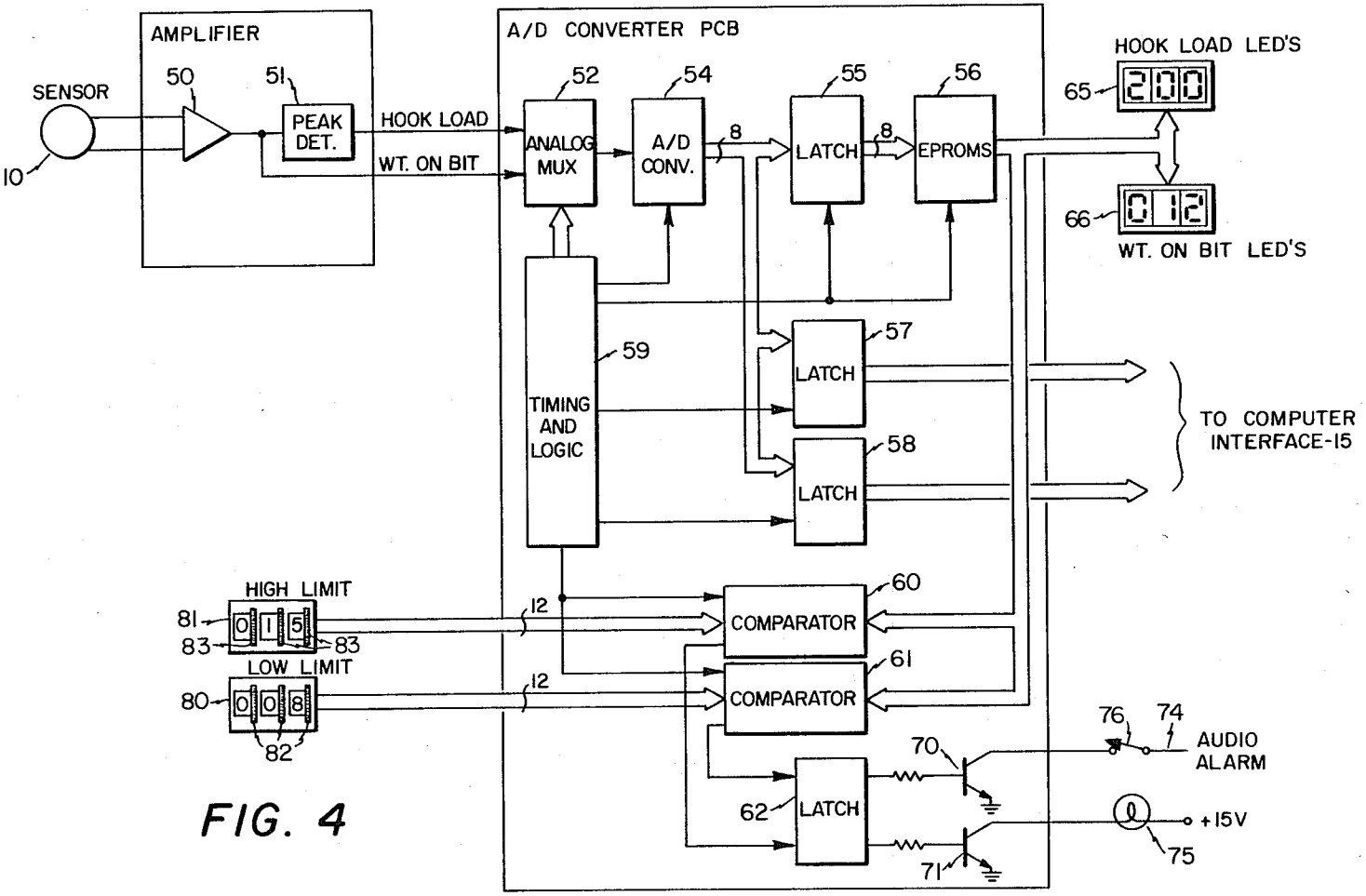
FIG. 4 is a schematic diagramatical view of one of the units utilized to process the analog data from a sensor.

Referring now to FIG. 4, there is illustrated in block and schematic notation the components of one of the units 10, 11–N. More specifically FIG. 4 illustrates the components of the system related to the parameters of hook load and weight on bit. It was selected for illustration and description inasmuch as it embodies the features to be found in the other units and the understanding of its operation will make obvious to the art the manner in which the other units may be constructed. The sensor 10 which may be a strain gage or the like and connected to the deadline on the drilling rig produces a 20 milliamp signal which is applied to the amplifier 50 and peak detector 51. The peak detector 51 is utilized to determine maximum hook load. In establishing maximum hook load the drill pipe and collars are lowered to a point just off bottom. As additional strings of drill pipe are added to the string, the hook load will increase and this value will be held for observation until the hook load is changed by the addition of more lengths of drill pipe. The output of amplifier 50, a DC voltage, together with the output from the peak detector 51 is applied to analog multiplexer 52 which selects either hook load or weight on bit values and applies them to an analog to digital converter 54. The output of the A/D converter 54 is an eight bit binary signal applied to latch 55 by way of a bus where the signal is held momentarily under control of timing and logic means 59 until the next binary value is generated by the A/D converter 54. The output of latch 55, an eight bit signal, is applied as an address to a binary to BCD converter 56. In accordance with the present invention the conversion from binary to binary coded decimal is performed by an erasable programmable read only memory (EPROM) and the BCD representations of the measured signals are applied to LED 65 displaying hook load or to LED 66 visually displaying weight on bit.

The eight bit binary signal from the A/D converter 54 is also applied by way of buses to latch 57 and latch 58 for transmission to the computer interface 15 of FIG. 1. Accordingly, the hook load and the weight on bit are continuously visually displayed to the operator and the values of these parameters are also transmitted to the computer interface 15 for recording on the file disk by way of the slave computer 16 of FIG. 1.

In conducting any drilling operation certain minimum and maximum values for weight on bit and hook load are established depending upon the drilling conditions to be encountered. Automatically, to determine that the weight on bit is within the established limits, comparators 60 and 61 are provided which under control of the timing and logic circuit 59 compare in real time measured values of weight on bit with the minimum and maximum values operator set for the operation. Specifically the BCD representation of weight on bit is applied by way of a bus to an input of the comparator 60 and to input of the comparator 61. The maximum or high limit for weight on bit is generated in BCD format by thumbwheel switch 81 and the minimum or low limit value for weight on bit is generated by the thumbwheel switch 80 also in BCD format.

Comparators 60 and 61 compare the measured value of weight on bit with the maximum and minimum values established by adjusting with thumb-wheels 82 and 83 the thumbwheel switches 81 and 80. Should weight on bit wander outside the range established by the operator, signals will be produced and applied to latch 62 and thence by way of transistor 70 and 71 to excite an audible alarm 74 and a visual alarm 75. The audible and visual alarms will immediately notify the operator that the weight on bit is outside of preestablished limits and will require an action on his part. While the audible alarm may be disabled by opening switch 76 or it will time out after approximately 30 seconds, the only way to disable the visual alarm is to have the tool pusher adjust the weight on bit to bring it back within prescribed limits or at the operators discretion a change may be made in the upper and lower limit depending upon drilling requirements and knowledge of the actual weight on bit as visually displayed by way of LED 66.

The system is comprised of standard off the shelf components. For example, the analog multiplexer is an ADC0808, available from National Semiconductors and the timing and logic function 59 is provided by two 74123 and a 74161. The latter ICs are available from a number of sources including Texas Instruments, Motorola and Mostek. The latches 55, 57 and 58 are 74LS273 and the comparators 60 and 61 are 7485. The latch 62 is a 7474 and the audible and visual alarms are driven by 2 N2222 transistors. The EPROMS are TMS2532.

While any number of conventional binary to BCD converters are available their use would take up printed board space and introduce higher maintenance problems because of the large number of ICs that would be required to perform the conversion function. The EPROM is an ideal integrated circuit for providing the binary to BCD conversion. It is obvious that it is desirable to use the full range of output from any of the A/D converters 54 in whatever panel they are associated with. The range typically in decimal notation is zero to 255. However, in order to have a meaningful BCD conversion for such varied parameters as temperature, pressure, torque and mud flow, it is necessary that the EPROMS be properly programmed in order to produce a meaningful BCD output. The relationship between BCD output and binary input for the EPROMS as they relate to some typical drilling parameters as set forth below in Table A.

TABLE A

| Drilling Parameters | Binary Input (Decimal) | BCD Output (Decimal) |
|---|---|---|
| Mud Temperature | 0–255 | 0–300 |
| Mud Conductivity | 0–255 | 0–9.96 |
| Mud Density | 0–255 | 0–30.0 |
| Standpipe Pressure | 0–255 | 0–5000 |
| Torque | 0–255 | 0–996 |
| Mud Flow | 0–255 | 0–99.6 |
| Weight on Bit | 0–255 | 0–996,000 |
| Mud Volume | 0–255 | 0–3000 |

To provide the conversion two TMS 2532 EPROMS are utilized. The inputs to the EPROMS are tied together. One of the EPROMS is the lower BCD output in tens and the ones digit and the other EPROM is the higher BCD output or the hundreds digit. The programming of the EPROM is accomplished by utilizing a standard EPROM programmer, connect the EPROM to it and in turn connect the programmer to a computer. The Apple II is in turn programmed to establish the relationship between the binary input and the BCD output, together with whatever address is desirable. In the alternative fully programmed EPROMS are commercially available on a custom basis. We need only specify to the supplier of the EPROMS the desired relationship and the EPROMS will be provided in a preprogrammed manner.

Now that the invention has been described, modifications will occur to those skilled in the art and it is intended to cover such modifications as fall within the scope of the appended claims.

What is claimed is:

1. A mud logging system for receiving and displaying conditions measured during the drilling of a well comprising:

(a) a plurality of units operative independently of each other for receiving and processing signals from sensors responsive to the values of the conditions, (b) A/D converters in each of said units for producing digital representations of signals received from said sensors, (c) visual display means in said units responsive to the outputs of said A/D converters for digitally displaying values of the conditions, (d) a computer of the digital type, (e) means interfacing said A/D converters and said computer, (f) a file disk, (g) means under control of said computer for transferring the digital representations to said file disk, and (h) a recorder under control of said computer for continuously displaying selected ones of said conditions.

2. The system of claim 1 including a master computer of the digital type connected to access data on said file disc, and means for programming said master computer to utilize said accessed data to provide for analysis of drilling conditions.

3. The system of claim 1 in which said computer is programmed to provide analysis of drilling conditions and to cause the display of the analysis in real time.

4. The system of claim 1 in which the analysis includes the computation of chloride content of drilling mud in accordance with the expression $$F = \frac{16070 \times 10^{\left(\frac{50-T}{350}\right)\times(1.4517+.07367 \log R)}}{1.05166R}$$

where:

F-chloride content in parts per million

R-reciprocal of conductivity of ohms per meter

T-temperature of the mud in degrees Fahrenheit.

5. The system of claim 4 in which the values of chloride content are visually displayed in real time and periodically stored on said file disk.

6. The system of claim 1 including:

(a) a master computer of the digital type, (b) a program disk, and means interfacing said master component with said file disk and said program disk.

7. The system of claim 6 in which means are provided initially to load said first named computer from said program disk and thereafter to render said first named computer independent of changes made to the program instructions on said program disk.

8. The system of claim 6 in which values of conditions on said file disk are accessed by said master computer to provide analysis of drilling conditions.

9. The system of claim 6 in which said master computer is enabled to access said program disk to effect changes in said programs for subsequent use by said first named computer.

10. A mud logging system for receiving and displaying conditions measured during the drilling of a well comprising:

(a) a plurality of display means for receiving signals from sensors responsive to the values of the conditions, each said display means including, (b) A/D converters for producing binary representations of signals from the sensors, (c) timing and logic means, (d) latch means under control of said timing and logic means for holding sequential values of said binary representations, and (e) means connected to said latch means for converting said binary representations to BCD representations, said converting means comprising at least one erasable programmable read only memory (EPROM) device.

11. The system of claim 10 including means for establishing upper and lower acceptable values for said conditions, and means for comparing the digital values of a condition with said upper and lower values.

12. The system of claim 11 including audible and visual alarms responsive to said comparators for signaling when said condition ranges outside said upper or lower limits.

13. The system of claim 12 wherein said visual alarm, after excitation, is terminated when the value of said condition falls within said upper and lower values.

14. The system of claim 12 wherein said visual alarm, after excitation is terminated upon establishing new values for said upper or lower limits.

15. The system of claim 11 in which said A/D converter, latch means, EPROM and comparators are under control of said timing and logic means.

16. The system of claim 11 including, (a) a computer of the digital type, (b) means interfacing said A/D converters and said computer, (c) a file disk, (d) means under control of said computer for periodically transferring said binary representations from computer memory to said file disc, and (e) a recorder under control of said computer for continuously displaying analog representations of at least one of said conditions.

17. The system of claim 16 in which each said display means is operable independently of said computer.

* * * * *